United States Patent [19]

Wilkening et al.

[11] Patent Number: 4,890,435

[45] Date of Patent: Jan. 2, 1990

[54] WINDOW GRILLE AND RETAINER ASSEMBLY

[75] Inventors: Steven R. Wilkening, Grand Rapids; Lawrence Mulder, Holland, both of Mich.

[73] Assignee: ODL, Incorporated, Zeeland, Mich.

[21] Appl. No.: 289,743

[22] Filed: Dec. 27, 1988

[51] Int. Cl.[4] ..... E06B 3/30

[52] U.S. Cl. ..... 52/456

[58] Field of Search ..... 52/455, 456, 507, 664, 52/717

[56] References Cited

U.S. PATENT DOCUMENTS 3,221,462 12/1965 Pomeroy .
3,293,817 12/1966 MacGregor .
3,340,661 9/1967 Krieger .
3,358,412 12/1967 Martin .
3,372,522 3/1968 Engstrom .
3,381,431 5/1968 Jacobson .
3,411,258 11/1968 Kessler .
3,504,468 4/1970 Martin .
3,645,058 2/1972 Jacobson et al. .
3,686,814 8/1972 Anderson .
4,437,284 3/1984 Cribbes et al. .
4,466,220 8/1984 Lewkowitz ..... 52/507 X
4,644,721 2/1987 Bloomquist et al. .
4,665,663 5/1987 Governale .

*Primary Examiner*—David A. Scherbel
*Assistant Examiner*—Jerrold D. Johnson
*Attorney, Agent, or Firm*—Warner, Norcross & Judd

[57] ABSTRACT

A window assembly creating a multi-pane appearance of a single mounted glazing panel, includes a panel, a frame, a grille and retainer slides slidably mounted on the grille for securely but releasably attaching the grille to the frame. The frame and panel cooperate to define a gap therebetween which is adapted to releasably receive a portion of the retainer slide.

30 Claims, 2 Drawing Sheets

WINDOW GRILLE AND RETAINER ASSEMBLY

BACKGROUND OF THE INVENTION

The present invention pertains to a window grille, and in particular to an assembly for securing a grille to a frame assembly.

The appearance of multi-paned windows are preferred by many people over the single-paned style. However, a multi-paned window structure is more expensive to manufacture and more difficult to clean, paint and otherwise maintain. To alleviate these difficulties, grille units have been developed which overlie a single pane and give the appearance of a multi-paned structure. Further, many prior grille units have been releasably secured to the window frame assembly so that cleaning, staining and other operations may be more easily performed. However, while these type of units lower the cost of fabrication and reduce the maintenance requirements, they have experienced mounting problems.

Several ways of releasably attaching the grilles have been designed. The primary alternatives have included: (1) providing fasteners having sharp projections which are forcibly pushed into the window frame; (2) providing fasteners which are fixedly attached to the window frame and secure the grille unit with a snap-fit construction; and (3) providing pins which are inserted into correspondingly drilled holes in the frame. Examples of these structures are disclosed in: U.S. Pat. No. 3,686,814 to Anderson, entitled FALSE WINDOW MUNTIN BAR STRUCTURE; U.S. Pat. No. 4,644,721 to Bloomquist et al., entitled GRILLE FASTENER SYSTEM AND METHOD OF USING THE SAME; and U.S. Pat. No. 3,221,462 to Pomeroy, entitled FASTENER FOR WINDOW STRUCTURES AND THE LIKE HAVING REMOVABLE MULLION UNITS.

These systems, however, have many shortcomings. As can be readily appreciated, the structures relying upon the forceful insertion of a sharpened projection are in reality difficult to install. The problem is even further aggravated if a hardwood is used, and cannot be practically employed in connection with a plastic window frame. The attendant piercing also mars and otherwise detracts from the appearance of the frame. The assemblies utilizing a snap-fit fastener require precise manufacturing to ensure that the grille bars accurately align with the attached fasteners. Further, these grilles are often difficult to grasp and remove from the engaged fasteners. The use of pin-hole arrangements also requires precise manufacturing so that the pins align with the corresponding holes. These constructions further tend to be less secure than other structures, since the pins frequently are not positively held within the holes.

SUMMARY OF THE INVENTION

The aforementioned problems are overcome in the present invention, wherein a grille is provided with unique retainer slides which easily and securely, releasably attach the grille to a specially shaped window frame having a recess adjacent the glass.

Each grille bar is configured to slidably mount a novel retainer slide on each of its ends. Each slide includes a projecting arm which is adapted for snug receipt within a gap defined between the frame assembly and the glazing panel.

This construction enables easy installation and removal of the grille without excessive force or any special skill or tools. Yet, the present structure still securely attaches the grille against unwanted slippage or movement. Further, the present invention ensures easy installation of the grille without the precision manufacturing heretofore required in many systems. This capacity further facilitates a lower cost of fabrication.

These and other objects, advantages and features of the present invention will be more fully understood and appreciated by reference to the written specification and appended drawings.

DETAILED DESCRIPTION OF THE PREFERRED EMBODIMENTS

Figure 1:
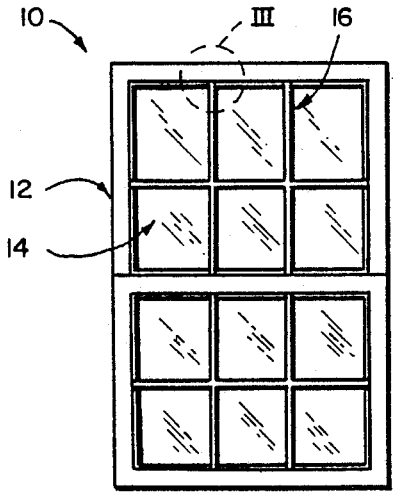
FIG. 1 is a front-elevational view of a window including an attached grille.
Figure 2:
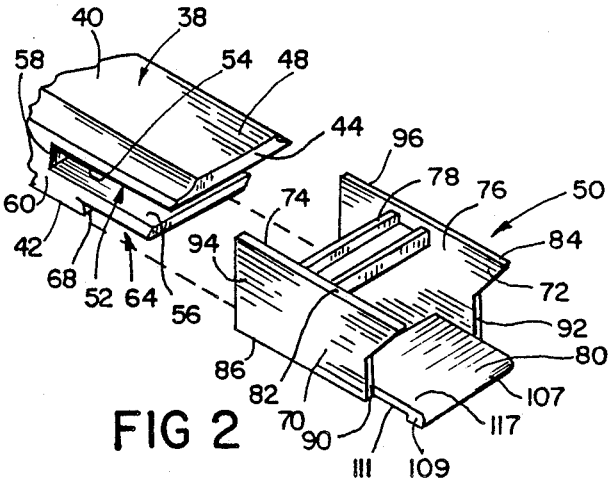
FIG. 2 is a fragmentary exploded view of a grille bar and a retainer slide of the present invention.

In the preferred embodiment, a window 10 includes a frame 12 mounting a glazing panel 14 and an overlapping grille structure 16. This arrangement may be used in a variety of different window types and styles. One common example is a sliding sash window (FIG. 1). The present structure is equally effective regardless of whether the window is of a plastic or wooden construction. Of course, other materials having the requisite characteristics could also be used.

Figure 4:
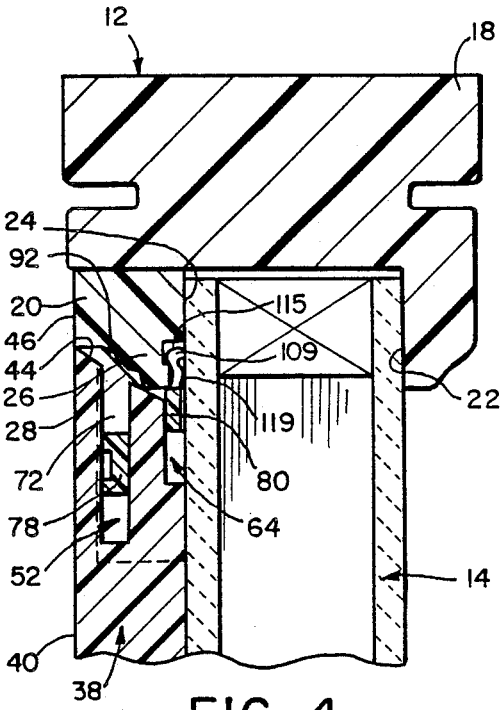
FIG. 4 is a cross-sectional view taken along line IV—IV in FIG. 3.

As illustrated, the glazing panel 14 is a double insulated glass panel (FIG. 4) which is secured between an outer frame structure 18 and glazing stop 20 about its entire perimeter. Although virtually any type of panel and frame assembly structure could be used. Glazing stop 20 may be attached to frame structure 18 in the manner disclosed in copending application Ser. No. 113,739, filed Oct. 23, 1987, and entitled INTEGRAL DOOR LIGHT WITH GLAZING STOP, or in any other known manner. As seen in FIG. 4, panel 14 is gripped securely between a pair of opposed mounting surfaces 22, 24 on the frame structure 18 and stop 20, respectively.

Figure 5:
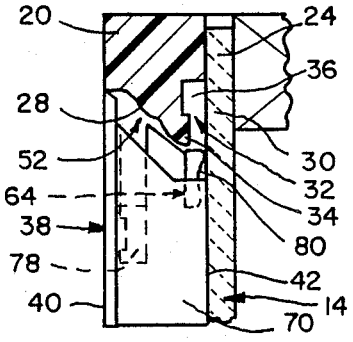
FIG. 5 is a fragmentary cross-sectional view taken along line V—V of FIG. 3 with the slide recessed for installation.
Figure 6:
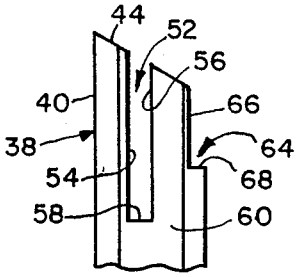
FIG. 6 is a fragmentary side-elevational view of an end of one of the grille bars.
Figure 7:
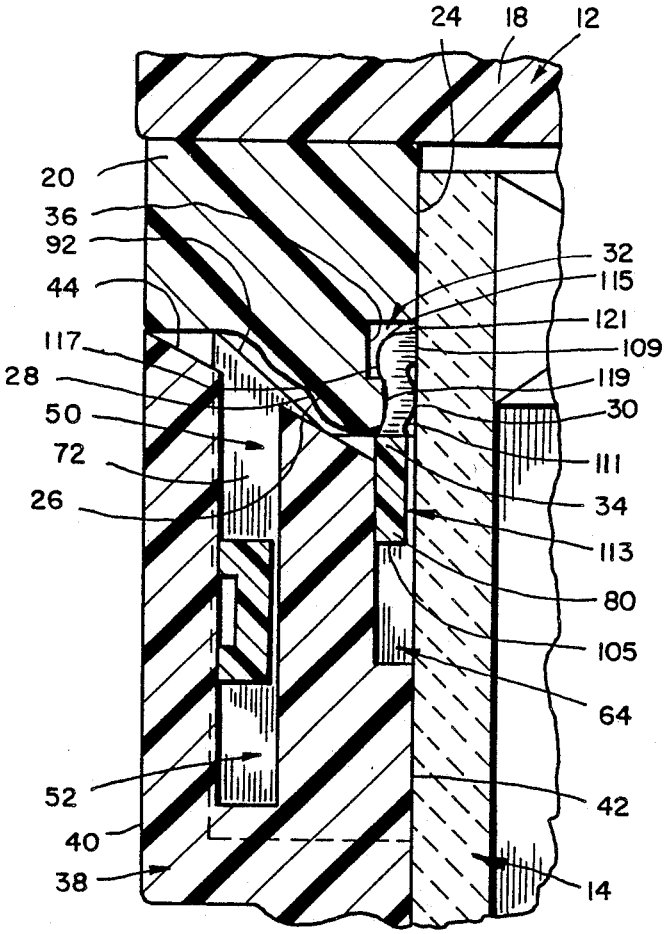
FIG. 7 is an enlarged, fragmentary cross-sectional view taken along line VII—VII in FIG. 3.
Figure 8:
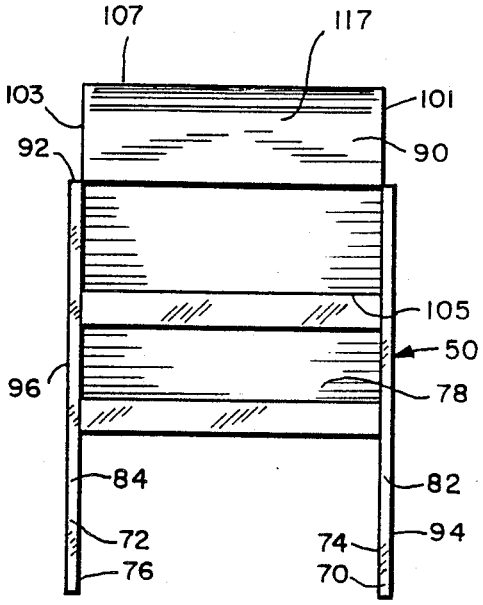
FIG. 8 is a top plan view of the retainer slide.
Figure 9:
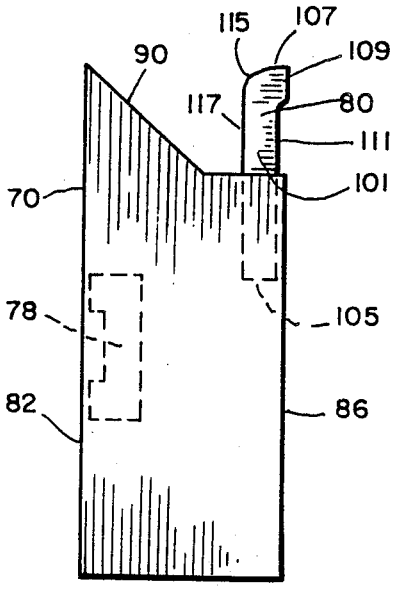
FIG. 9 is a side elevational view of the retainer slide.
Figure 10:
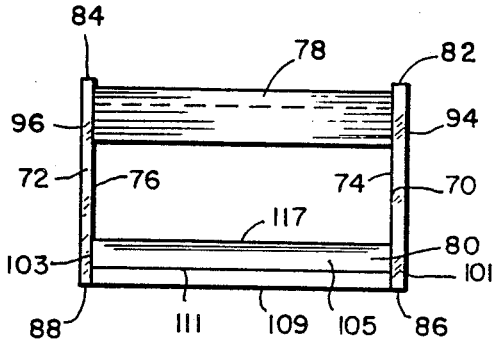
FIG. 10 is a front elevational view of the retainer slide.

Glazing stop 20 further includes an inwardly projecting leg 26 having an outer surface 28 contoured for aesthetic appeal and an inner surface 30 spaced from panel 14 to define a continuous gap 32 about the perimeter thereof (FIGS. 4, 5 and 7). Inner surface 30 further has a stepped configuration defined by a distal foot 34 and a recessed face 36. This structure effects a secure mounting of grille 16, as will be described in more detail below.

The grille 16 is comprised of a plurality of intersecting vertical and horizontal grille bars 38 (FIG. 1). Grille bars 38 are secured together in any known manner (such as by gluing or nailing) to form an integral grille structure 16 adapted for mounting to frame 12. More specifically, grille bars 38 each include an exterior surface 40 exposed for viewing, an inner surface 42 adapted to engage and lie flush against panel 14, and an end face 44 which is beveled to accommodate leg 26 of glazing stop 20 (FIGS. 2–6). Preferably, when assembled, the exterior surfaces 40 of grille bars 38 are aligned with the exterior surface 46 of glazing stop 20 for visual appeal (FIGS. 4, 5 and 7).

The ends 48 of each grille bar 38 are specially configured to slidably mount a retainer slide 50 designed to releasably mount grille 16 to frame 12 (FIGS. 2 and 4–7). More particularly, each end 48 includes a pair of substantially parallel cutouts. First, a slot 52 is defined medially in end 48 by a pair of opposing walls 54, 56 and a stop wall 58. Walls 54, 56 are positioned generally parallel to exterior and inner surfaces 40, 42 of bar 38. Further, slot 52 opens at end face 44 and along each lateral side 60, 62 of grille bar 38. Second, a recess 64, defined by a recessed wall 66 and a shoulder 68, is formed along the inner surface 42. Cutouts 52, 64 cooperate with one another to slidably receive portions of retainer slide 50 for slidable mounting thereof on grille bar 38.

Figure 3:
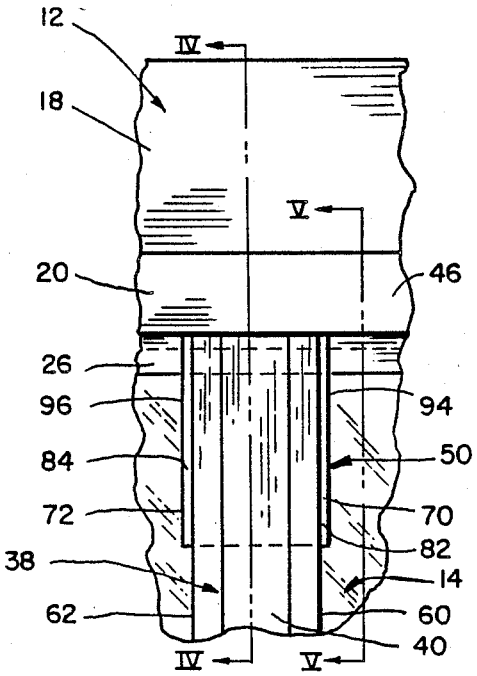
FIG. 3 is an enlarged fragmentary view of a portion of the window encircled by line III in FIG. 1.

Retainer slides 50 (FIGS. 2 and 8–10) each include a pair of parallel side panels 70, 72 spaced apart so that their inner faces 74, 76 matingly receive sides 60, 62 of the grille bar 38 to which it is mounted (FIG. 3). Side panels 70, 72 are interconnected by a bridge 78 and a projecting arm 80. Bridge 78 is fixedly attached to inner faces 74, 76 near the top edges 82, 84 of panels 70, 72. Preferably, bridge 78 has a shallow, U-shaped cross-sectional configuration for additional strength (FIGS. 2, 4, 5, 7 and 9), although virtually any shape could be used. Arm 80 is also fixedly attached to inner faces 74, 76 near bottom edges 86, 88 of panels 70, 72. Arm 80 extends beyond front edges 90, 92 of panels 70, 72 to facilitate its receipt within gap 32 (FIGS. 4 and 7), as discussed below.

Each slide 50 is mounted to a grille bar 38 by receiving bridge 78 in slot 52 and arm 80 in recess 64 (FIGS. 4, 5 and 7). Further, bottom edges 86, 88 of side panels 70, 72 are positioned in alignment with inner surface 42 of the corresponding grille bar 38 and therefore are to be engaged flush against panel 14 when grille 16 is installed. This engagement of bottom edges 86, 88 with panel 14 acts to hold the slide 50 steadily in its proper orientation. Additionally, top edges 82, 84 of side panels 70, 72, are preferably recessed below exterior surface 40 of the corresponding grille bar 38 to reduce the visual impact of slide 50. Moreover, in the most preferred embodiment, slides 50 are composed of a transparent plastic material so that they are not readily detected by the casual observer. Also, similarly to end face 44, front edges 90, 92 are beveled along their outer portions to accommodate the projecting leg 26 of glazing stop 20 (FIGS. 2, 4, 5, 7 and 9).

When attaching grille 16 to frame 12, all of the slides 50 are retracted until bridge 78 and arm 80 engage stop wall 58 and shoulder 68, respectively (FIG. 5). In this position, projecting arm 80 is completely received within recess 64 to thereby avoid causing interference with glazing stop 20 during the placement of grille 16 against panel 14. Once grille 16 engages panel 14, slides 50 are individually grasped along the outer faces 94, 96 of side panels 70, 72, and manually extended until arm 80 is securely inserted within gap 32 (FIGS. 4 and 7). The continuous nature of gap 32 obviates misalignment problems encountered in many prior art devices as discussed above.

Arms 80 of slides 50 function to secure and hold grille 16 in place. Each arm 80 is essentially a rectangular plate having a pair of side walls 101, 103 which are interconnected by a fixed end 105 and a free end 107 (FIGS. 2 and 8–10). More specifically, arm 80 is fixedly secured to panels 70, 72 along its side walls 101, 103 in a cantilevered manner, such that approximately one-half of the arm extends forwardly beyond the inner portions of front edges 90, 92. The free end 107 of arm 80 is rolled over to form an engagement pad 109 adapted to engage panel 14 (FIGS. 4, 5 and 7). Pad 109 is substantially coplanar with bottom edges 86, 88 of side panels 70, 72 and offset slightly beyond the inner surface 111 of arm 80. This arrangement defines a small gap 113 between inner surface 111 and panel 14. The rolled shape of free end 107 provides an arcuate corner 115 which aids in the insertion of arm 80 within gap 32.

In attaching a grille bar 38 to frame 12, the bar is first placed against panel 14 such that interior surface 42, bottom edges 86, 88 and pad 109 are engaged flush thereagainst (FIG. 5). Slide 50 is then slid forwardly so that free end 107 of arm 80 engages the distal foot 34 of leg 26. The outer surface 117 of arm 80 is spaced slightly farther from panel 14 than the mounting face 119 of foot 34. Consequently, upon moving slide 50 further forward, a friction fit causes the mounting face 119 to tightly engage outer surface 117. This forward movement is continued until front edges 90, 92 of panels 70, 72 abuttingly engage glazing stop 20 (FIGS. 4 and 7).

Once arm 80 has been fully inserted within gap 32, pad 109 extends past foot 34 and into the enlarged portion 121 of gap 32. Under the pressure of foot 34, arm 80 flexes slightly into a bowed configuration (as shown in an exaggerated manner in FIGS. 4 and 7). This flexing enhances the interference fit of arm 80 in gap 32. Yet, while arm 80 is thereby securely held against inadvertent release from gap 32, it can still be easily removed therefrom by retracting the slide 50 into slot 52 and recess 64.

The above description is that of a preferred embodiment of the invention. Various alterations and changes can be made without departing from the spirit and broader aspects of the invention as set forth in the appended claims, which are to be interpreted in accordance with the principals of patent law, including the doctrine of equivalents.

The embodiments of the invention in which an exclusive property or privilege is claimed are defined as follows:

1. A window comprising:

a panel;

a frame having first means for supporting said panel, and second means for defining a gap between said panel and said frame;

a grille overlying said panel and including at least one grille bar having an end positioned closely adjacent said frame and defining a slot; and a retainer having a first portion received within said slot for movably mounting said retainer on said end of said grille bar and a second portion received within said gap for releasably securing said grille to said frame.

2. A window as defined in claim 1 wherein said first means of said frame includes a pair of opposing surfaces engaging opposite sides of said panel, and wherein said second means includes a face offset from said opposing surfaces and spaced from said panel to form said gap therebetween.

3. A window as defined in claim 2 in which said frame further includes an outer frame structure and a glazing stop attached thereto, wherein said outer frame structure and said glazing stop each include one of said opposing surfaces, and wherein said glazing stop further includes said face defining the gap.

4. A window as defined in claim 2 wherein said face extends substantially about the entire perimeter of said panel and thereby forms said gap substantially about the entire perimeter of said panel.

5. A window as defined in claim 2 wherein said retainer includes a pair of side members which slidably receive said grille bar therebetween and an arm which is received within said gap to attach said grille to said frame.

6. A window as defined in claim 1 wherein said retainer includes a pair of side members which slidably receive said grille bar therebetween and an arm which is received within said gap to attach said grille to said frame.

7. A window comprising:

a panel;

a frame having first means for supporting said panel, and second means for defining a gap between said panel and said frame;

a grille overlying said panel and including at least one grille bar having an end positioned closely adjacent said frame, said grille bar including a slot; and a retainer movably mounted on said end of said grille bar, said retainer including a pair of side members slidably receiving said grille bar therebetween, an arm adapted for receipt within said gap to attach said grille to said frame, and a bridge interconnecting said side members and extending through said slot to slidably mount said retainer to said grille bar.

8. A window as defined in claim 7 wherein said arm is received into said gap in a tight interference fit.

9. A window comprising:

a panel;

a frame having first means for supporting said panel, and second means for defining a gap between said panel and said frame;

a grille overlying said panel and including at least one grille bar having an end positioned closely adjacent said frame; and a retainer movably mounted on said end of said grille bar, said retainer including a pair of side members which slidably receive said grille bar therebetween, an arm adapted for receipt within said gap to attach said grille to said frame and retainer mounting means positioned between said side members and extending at least partially into said grille bar for slidably mounting said retainer to said grille bar.

10. A window comprising:

a panel;

a frame having means for supporting said panel, and means for defining a substantially continuous gap about the perimeter of said panel;

a grille adapted to overlie said panel and including at least one grille bar having a pair of opposite ends; and a retainer movably mounted on each end of said grille bar, each said retainer having an insertion portion, each said retainer being movable along said grille bar between one position in which said insertion portion is releasably received within said gap to releasably secure said grille to said frame and another position in which said insertion portion is released from said gap.

11. A window as defined in claim 10 wherein said frame includes a marginal portion which overlies said panel and forms therewith said substantially continuous gap.

12. A window as defined in claim 11 in which said frame further includes an outer frame structure and a glazing stop attached thereto, wherein said glazing stop includes a leg which forms said marginal portion overlying said panel and defining said substantially continuous gap.

13. A window as defined in claim 11 in which said insertion portion of each said retainer includes an extended arm which has a free end defining a pad which engages said panel, an inner surface spaced from but facing said panel, and an exterior surface facing away from said panel, wherein said marginal portion of said frame engages said exterior surface when said arm is received within said gap such that said arm is bowed slightly to create a tight interference fit, whereby said grille is securely attached to said frame.

14. A window as defined in claim 10 in which said insertion portion of said retainer is shaped and dimensioned relative to said gap such that said insertion portion is slightly bowed when received within said gap to create a tight interference fit, whereby said grille is securely attached to said frame.

15. A window comprising:

a panel;

a frame having means for supporting said panel, and means for defining a substantially continuous gap about the perimeter of said panel;

a grille adapted to overlie said panel and including at least one grille bar having a pair of opposite ends, each said end of said grille bar including an end face adapted to be positioned closely adjacent said frame when attached thereto; and a retainer movably mounted on each end of said grille bar, said retainer having an insertion portion releasably received within said gap to releasably secure said grille to said frame, and said retainer being slidably mounted for movement along said grille bar between one position wherein said insertion portion is recessed such that it is positioned between said grille bar end faces to facilitate placement of the grille bar against said panel, and another position wherein said insertion portion is extended such that it is positioned beyond one of said end faces to be received within said gap.

16. A window comprising:

a panel;

a frame having means for supporting said panel, and means for defining a substantially continuous gap about the perimeter of said panel;

a grille adapted to overlie said panel and including at least one grille bar having opposite ends; and a retainer movably mounted on each end of said grille bar, said retainer including a pair of spaced apart side members adapted to receive said grille bar therebetween, retainer mounting means positioned between said side members and extending at least partially into said grille bar for slidably mounting said retainer to said grille bar, and an insertion portion releasably received within said gap to releasably secure said grille to said frame.

17. A window as defined in claim 16 wherein said grille bar further includes a slot, and said retainer mounting means includes a bridge interconnecting said side members and extending through said slot to slidably mount said slide to said grille bar.

18. A window comprising:

a panel;

a frame supporting said panel;

a grille releasably attached to said frame and including at least one grille bar overlying said panel, said grille bar having an inner surface engaging said panel, an exterior surface facing away from said panel, and a pair of end faces positioned closely adjacent said frame; and a retainer slide including an insertion portion releasably received within said frame for attaching said grille thereto, said slide being slidably mounted to said grille bar and positioned entirely between planes defined by said inner and exterior surfaces of said grille bar, said slide being slidable along said grille bar between one position wherein said insertion portion is recessed such that it is positioned between said grille bar end faces to facilitate placement of the grille bar against said panel, and another position wherein said insertion portion is extended such that it is positioned beyond one of said end faces to be received within said frame.

19. A window as defined in claim 18 wherein said retainer slide further includes a pair of spaced apart side members receiving said grille bar therebetween and slide mounting means positioned between said side members and extending at least partially into said grille bar for slidably mounting said slide to said grille bar.

20. A window as defined in claim 19 wherein said grille bar further includes a slot and said slide mounting means includes a bridge interconnecting said side members and extending through said slot to slidably mount said slide to said grille bar.

21. A window as defined in claim 18 in which said insertion portion of said slide is shaped and dimensioned relative to said defined gap such that said insertion portion is slightly bowed when received within said gap to create a tight interference fit, whereby said grille is securely attached to said frame.

22. A window comprising:

(a) glazing panel;

(b) a frame assembly supporting said glazing panel and defining at least one opening;

(c) a grille, having grille bars, each said grille bar defining at least one slot; and (d) retainer slides mounted on said grille bars for attaching said grille to said frame, each slide comprising:

(i) a pair of side panels adapted to be received about a corresponding grille bar, each said side panel including a front edge;

(ii) a bridge interconnecting said side panels and received within one of said grille bar slots to slidably mount said slide to the corresponding grille bar; and (iii) an arm having a fixed end and a free end, said fixed end being fixed to and interconnecting said side panels and said free end projecting outwardly in a cantilevered manner beyond said front edges to be received in said opening defined in said frame.

23. A window as defined in claim 22 wherein said side panels of said slides further include lower edges which engage said panel, and wherein said arm is positioned closely adjacent to and substantially parallel to said lower edges.

24. A window as defined in claim 22 in which said free end of said arm of each said slide defines a pad adapted to engage said panel, and in which said arm further includes an inner surface, and an exterior surface facing in a direction opposite to said inner surface, whereby said arm is adapted to be bowed slightly when received within said opening in said frame to create a tight interference fit for securely attaching said grille to said frame.

25. A window comprising:

(a) glazing panel;

(b) a frame assembly supporting said glazing panel and defining at least one opening;

(c) a grille having grille bars each including a pair of opposite ends, each said end being positioned closely adjacent said frame assembly and including a slot and a recess; and (d) retainer slides mounted on said grille bars for attaching said grille to said frame, each slide comprising:

(i) a pair of side panels adapted to be received about a corresponding grille bar, each said side panel including a front edge;

(ii) a bridge interconnecting said side panels to slidably mount said slide within said slot of the corresponding grille bar; and (iii) an arm having a fixed end and a free end, said fixed end being fixed to and interconnecting said side panels and said free end projecting outwardly in a cantilevered manner beyond said front edges, said arm being adapted to be received in said opening defined in said frame to attach the grille to the frame, and being adapted to be received in said recess when said arm is removed from said opening.

26. A retainer slide for use in attaching a grille having grille bars to a frame supporting a glazing panel and defining at least one opening for said slide, said slide comprising:

a pair of side panels adapted to be received about a corresponding grille bar, each said side panel including a front edge;

a bridge positioned between and interconnecting said side panels to slidably mount said slide to the corresponding grille bar, said bridge being further positioned such that at least a portion of said bridge extends substantially rearwardly of said front edges of said side members, whereby said bridge is received within a slot in the corresponding grille bar; and an arm having a fixed end and a free end, said fixed end being fixed to and interconnecting said side panels and said free end projecting forwardly in a cantilevered manner beyond said front edges, to be received in said opening defined by the frame.

27. A retainer slide as defined in claim 26 wherein said side panels each further include a lower edge which engages a glazing panel, and wherein said arm is positioned closely adjacent to and substantially parallel with said lower edges.

28. A retainer slide as defined in claim 26 in which said free end of said arm defines a pad adapted to engage the glazing panel, and in which said arm further includes an inner surface recessed inwardly from said pad so as to be spaced from the glazing panel supported by the frame, and an exterior surface facing in an direction opposite to said inner surface, whereby said arm is adapted to be bowed slightly when received within the opening in the frame to thereby create a tight interference fit for securely attaching the grille to the frame.

29. A window comprising:

a panel;

a peripheral frame supporting said panel and having an offset portion defining at least one gap between itself and said panel;

a grille overlying said panel and including at least one grille bar having at least one end positioned closely adjacent said frame; and a retainer having a projection adapted to be releasably received within said gap for attaching said grille to said frame, said retainer being slidably mounted for reciprocal movement along said grille bar between a first position wherein said projection is inserted within said gap and a second position wherein said projection is released from said gap.

30. A window as defined in claim 29 wherein said frame further includes a pair of opposing surfaces engaging opposite sides of said panel, and wherein said offset portion includes a face offset from said opposing surfaces and spaced from said panel to form said gap therebetween.

* * * * *